US010191439B2

(12) United States Patent
Juri et al.

(10) Patent No.: US 10,191,439 B2
(45) Date of Patent: Jan. 29, 2019

(54) CLEANING BLADE, PROCESS CARTRIDGE, AND IMAGE FORMING APPARATUS

(71) Applicants: Keiichiro Juri, Kanagawa (JP); Masanobu Gondoh, Shiga (JP); Yohta Sakon, Kanagawa (JP); Masahiro Ohmori, Kanagawa (JP); Yuuki Mizutani, Kanagawa (JP); Yuka Aoyama, Kanagawa (JP)

(72) Inventors: Keiichiro Juri, Kanagawa (JP); Masanobu Gondoh, Shiga (JP); Yohta Sakon, Kanagawa (JP); Masahiro Ohmori, Kanagawa (JP); Yuuki Mizutani, Kanagawa (JP); Yuka Aoyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/886,940

(22) Filed: Feb. 2, 2018

(65) Prior Publication Data

US 2018/0239297 A1 Aug. 23, 2018

(30) Foreign Application Priority Data

Feb. 17, 2017 (JP) ..... 2017-028220

(51) Int. Cl.

| | |
|---|---|
| ***G03G 21/00*** | (2006.01) |
| ***G03G 21/18*** | (2006.01) |
| ***G03G 21/16*** | (2006.01) |

(52) U.S. Cl.

CPC ..... *G03G 21/0011* (2013.01); *G03G 21/1676* (2013.01); *G03G 21/181* (2013.01);
(Continued)

(58) Field of Classification Search

CPC ..... G03G 21/0011; G03G 21/0017; G03G 21/0029
(Continued)

(56) References Cited

U.S. PATENT DOCUMENTS 9,042,768 B2 * 5/2015 No ..... G03G 15/168 399/350
9,383,713 B2 * 7/2016 Sakon et al. ..... G03G 21/0017
(Continued)

FOREIGN PATENT DOCUMENTS

| | | |
|---|---|---|
| JP | 2006-259466 | 9/2006 |
| JP | 2012-150203 | 8/2012 |

*Primary Examiner* — William J Royer
(74) *Attorney, Agent, or Firm* — Oblon, McClelland, Maier & Neustadt, L.L.P.

(57) ABSTRACT

A cleaning blade includes a support and an elastic member with a flat shape. The elastic member has a secured end secured to the support and a free end. A ridgeline of the free end contacts a cleaning target to remove substances adhering to a surface of the cleaning target. The elastic member includes a base and a surface layer made of a cured product of a curable composition. The surface layer is disposed on at least a part of an opposite face disposed to oppose a downstream side of the cleaning target downstream from a contact portion of the elastic member with the cleaning target in a direction of movement of the cleaning target. A thickness of the surface layer progressively decreases toward the secured end along a cross section perpendicular to a longitudinal direction of the surface layer.

7 Claims, 6 Drawing Sheets

(52) U.S. Cl.
CPC ..... *G03G 21/1814* (2013.01); *G03G 21/1821* (2013.01); *G03G 21/1842* (2013.01)

(58) Field of Classification Search
USPC ..... 399/350, 351
See application file for complete search history.

(56) References Cited

U.S. PATENT DOCUMENTS

| | | | | |
|---|---|---|---|---|
| 9,395,676 | B2 * | 7/2016 | Sakaguchi et al. | G03G 21/0017 |
| 9,588,479 | B2 * | 3/2017 | Gohda et al. | G03G 21/0017 |
| 2008/0112742 | A1 | 5/2008 | Nakamori et al. | |
| 2008/0113285 | A1 | 5/2008 | Nakamori et al. | |
| 2016/0274500 | A1 | 9/2016 | Juri et al. | |
| 2016/0320740 | A1 | 11/2016 | Toyama et al. | |
| 2017/0003643 | A1 | 1/2017 | Aoyama et al. | |
| 2017/0017194 | A1 | 1/2017 | Toyama et al. | |

* cited by examiner

CLEANING BLADE, PROCESS CARTRIDGE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2017-028220, filed on Feb. 17, 2017, in the Japan Patent Office, the entire disclosure of which is hereby incorporated by reference herein.

BACKGROUND

Technical Field

This disclosure generally relates to a cleaning blade, a process cartridge, and an image forming apparatus, such as a copier, a printer, a facsimile machine, or a multifunction peripheral having at least two of copying, printing, facsimile transmission, plotting, and scanning capabilities.

Related Art

In electrophotographic image forming apparatuses, after a toner image is transferred onto a recording medium or an intermediate transferor, a cleaner removes toner remaining (i.e., residual toner) on a surface of an image bearer.

The cleaners employing a cleaning blade are widely used for simplicity in structure and high cleaning capability. The cleaning blade generally includes a support and an elastic member made of rubber such as polyurethane rubber. While a base end of the elastic member is supported by a support, a contact portion (i.e., ridgeline) of the elastic member is pressed against the surface of the image bearer to gather and scrape off the toner remaining on the surface of the image bearer.

SUMMARY

According to an embodiment of the present disclosure, an improved cleaning blade includes a support and an elastic member with a flat shape. The elastic member has a secured end secured to the support and a free end. A ridgeline of the free end contacts a cleaning target to remove substances adhering to a surface of the cleaning target. The elastic member includes a base and a surface layer made of a cured product of a curable composition. The surface layer is disposed on at least a part of an opposite face disposed to oppose a downstream side of the cleaning target downstream from a contact portion of the elastic member with the cleaning target in a direction of movement of the cleaning target. A thickness of the surface layer progressively decreases toward the secured end along a cross section perpendicular to a longitudinal direction of the surface layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
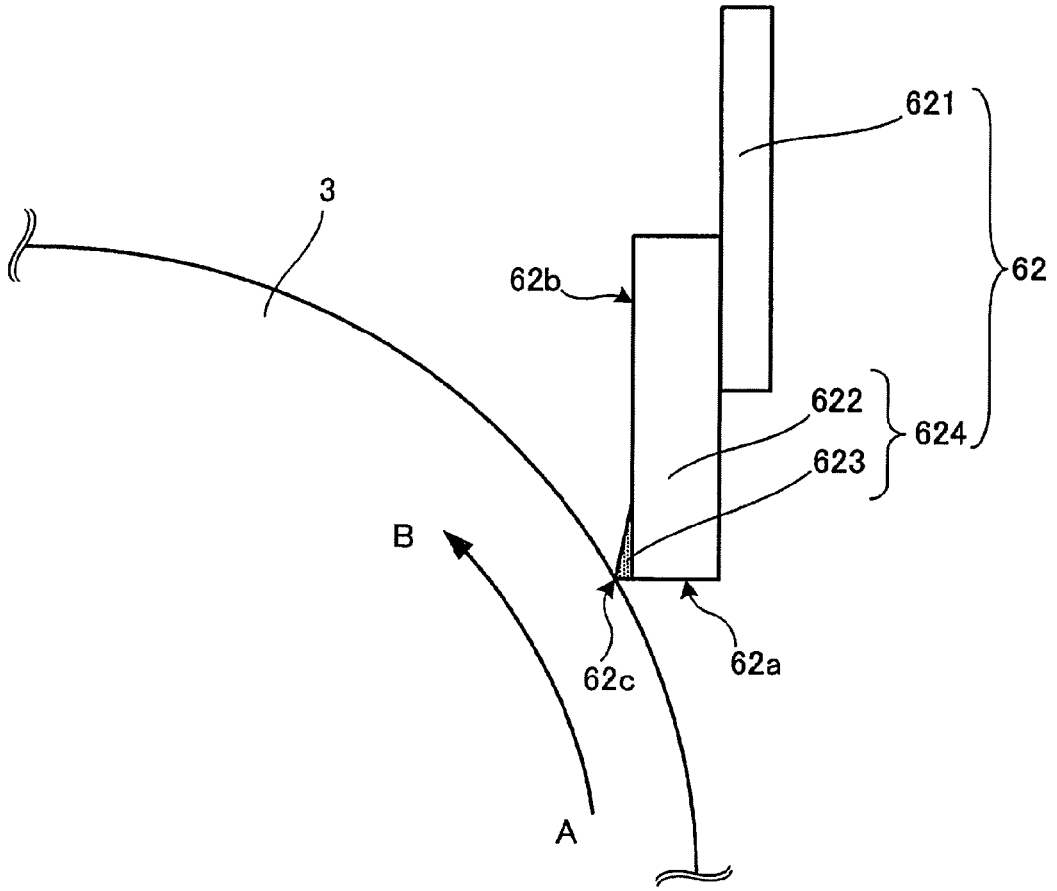
FIG. 1 is a schematic view illustrating a state in which a cleaning blade is in contact with a cleaning target according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In the drawings, like reference numerals designate identical or corresponding parts throughout the several views thereof. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of a cleaning blade, a process cartridge, and an image forming apparatus with reference to drawings.

Figure 2:
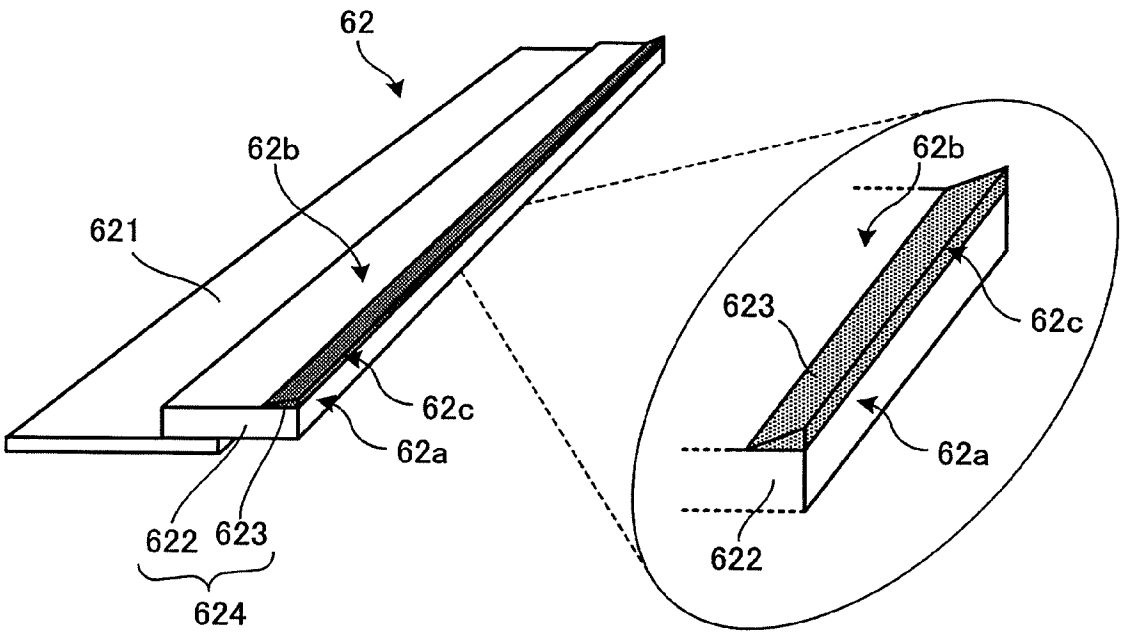
FIG. 2 is a perspective view and a partially enlarged view of the cleaning blade according to an embodiment of the present disclosure.

FIG. 1 is a schematic view illustrating a state in which a cleaning blade 62 is in contact with a surface of a photoconductor 3 as a cleaning target, and FIG. 2 is a perspective view and an enlarged view illustrating the cleaning blade 62 according to an embodiment of the present disclosure.

As illustrated in FIGS. 1 and 2, the cleaning blade 62 includes a support 621 and a flat, planar elastic member 624. The elastic member 624 is secured to one end of the support 621 with adhesive or the like, and the other end of the support 621 is supported by a casing of a cleaner 6 to be described later, so that the cleaning blade 62 becomes a cantilever.

In the present embodiment, a surface in a longitudinal direction of a base 622, which constitutes the elastic member 624, facing a downstream side in a direction of movement of the cleaning target (the direction from A to B indicated by arrow in FIG. 1) is referred to as an opposite face 62*b* of the base 622. The surface of the base 622 on the distal end facing an upstream side in the direction of movement of the cleaning target is referred to as an end face 62*a* of the base 622.

A contact portion of the elastic member 624 that contacts the surface of the cleaning target includes a ridgeline 62*c* of the elastic member 624. Note that in the case where the ridgeline 62*c* turns up or when the line pressure is high, a part of the end face 62*a* can also be the contact portion.

One end (secured end) of the elastic member 624 is secured to the support 621 and the other end is a free end. The ridgeline 62*c* on the free end of the elastic member 624 abuts against the surface of the cleaning target to remove substances adhering to the surface of the cleaning target to be cleaned. The elastic member 624 includes the base 622 and a surface layer 623 made of a cured product of a curable composition. When the surface of the base 622 opposed to the downstream side from the contact portion in the direction of movement of the cleaning target is referred to as the opposite face 62*b* of the base 622, the surface layer 623 including the contact portion is formed on at least a part of the opposite face 62*b* of the base 622. The surface layer 623 includes an inclined face inclined on the cross section perpendicular to the longitudinal direction so that a thickness of the surface layer 623 progressively decreases toward the secured end side.

Note that the inclined surface is not limited to a straight line and may have a curved shape, a stepped shape, or the like at least in part.

Figure 3:
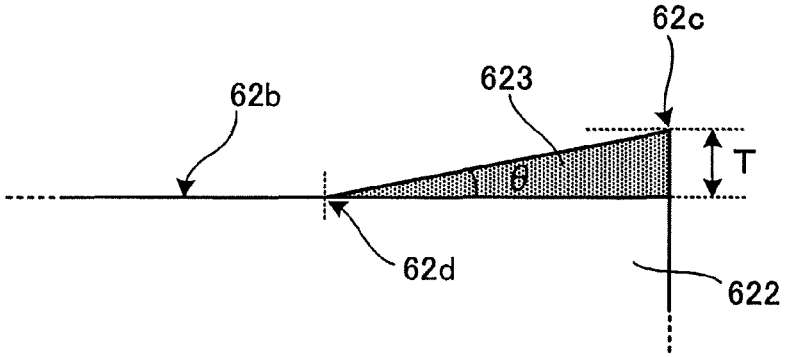
FIG. 3 is schematic view illustrating a surface layer of the cleaning blade on a cross section perpendicular to a longitudinal direction of the surface layer.

FIG. 3 is schematic view illustrating the surface layer 623 on the cross section perpendicular to the longitudinal direction of the surface layer 623.

The thickness T, illustrated in FIG. 3, of the surface layer 623 at the ridgeline 62*c* is preferably 10 μm to 200 μm.

In a case where the thickness T exceeds 200 μm, flexibility of the base 622 is hindered, an ability to track the surface of the cleaning target is not obtained preferably, and cracks of the elastic member 624 sometimes occur. On the other hand, in a case where the thickness T is less than 10 μm, a desired cleaning capability is not obtained and abnormal noise may be generated in some cases.

An angle θ, indicated by θ in FIG. 3, between the inclined face of the surface layer 623 (the face abutting the ridgeline 62*c* and the other end portion 62*d*) and the opposite face 62*b* is 0.1° to 11.3°.

In a case where the angle θ exceeds 11.3° or less than 0.1°, the ability to track the surface of the cleaning target may not be obtained satisfactorily in some cases.

It is preferable that the surface layer 623 extend for 1 to 8 mm from the contact portion. In a case where the surface layer 623 is formed in a region exceeding 8 mm from the end of the opposite face 62*b* on the contact portion side, the flexibility of the base 622 is hindered, and the satisfactory ability to track the surface of cleaning target may not be obtained in some cases.

The cured product of the curable composition constituting the surface layer 623 preferably has a higher Martens hardness than the base 622. By providing the surface layer 623 having high hardness, the surface layer 623 is less likely to deform, and it is possible to minimize the turning-up of the ridgeline 62*c*.

Specifically, it is preferable that the Martens hardness measured by a micro-hardness measurement instrument be 3.0 to 12 N/mm$^2$ at the ridgeline 62*c* of the surface layer 623.

Cleaning Target

Material, shape, structure, size, and the like of the cleaning target are not particularly limited and can be appropriately selected according to the purpose.

Examples of the shape of the cleaning target include a drum shape, a belt shape, a flat-plate shape, a sheet shape, and the like.

The size of the cleaning target is not particularly limited and may be appropriately selected according to the purpose, but the size that is usually used is preferable.

The material of the cleaning target is not particularly limited and may be appropriately selected according to the purpose, and examples thereof include metal, plastic, ceramic, and the like.

The cleaning target is not particularly limited and may be appropriately selected according to the purpose. In a case where the cleaning blade 62 is applied to an image forming apparatus 500, examples thereof include an image bearer and the like.

Substance to be Removed

The substances to be removed by the cleaning blade 62 of the present embodiment is not particularly limited as long as the substances are matters adhering to the surface of the cleaning target, and can be appropriately selected according to the purpose. For example, substances to be removed include but are not limited to toner, lubricant, inorganic fine particles, organic fine particles, dust, or a mixture thereof.

Support

Shape, size, material, and the like of the support 621 are not particularly limited and can be appropriately selected according to the purpose.

Examples of the shape of the support 621 include a flat-plate shape, a strip shape, a sheet shape, and the like.

The size of the support 621 is not particularly limited and can be appropriately selected according to the size of the cleaning target.

Examples of the material of the support 621 include metal, plastic, ceramic, and the like. Among above-mentioned materials, from the viewpoint of strength, a metal plate is preferable, and a steel plate such as stainless steel, an aluminum plate, and a phosphor bronze plate are particularly preferable.

Elastic Member

The elastic member 624 includes the base 622 and the surface layer 623 made of the cured product of the curable composition.

Shape, size, material, structure, and the like of the elastic member 624 are not particularly limited and can be appropriately selected according to the purpose.

Base

Examples of the shape of the base 622 include a flat-plate shape, a strip shape, a sheet shape, and the like.

The size of the base 622 is not particularly limited and can be appropriately selected according to the size of the cleaning target.

The material of the base 622 is not particularly limited and can be appropriately selected according to the purpose, but polyurethane rubber, polyurethane elastomer, or the like is preferable from the viewpoint that high elasticity can be easily obtained.

As a method for manufacturing the base 622, for example, a polyurethane prepolymer is prepared using a polyol compound and a polyisocyanate compound. Then, a curing agent and, if necessary, a curing catalyst are added to the polyurethane prepolymer. The polyurethane prepolymer is crosslinked in a predetermined mold, and post-crosslinked in a furnace. After shaping into a sheet shape by centrifugal molding, the sheet-shaped molding is left at normal temperature and aged, and then cut into flat plates with predetermined dimensions.

The polyol compound is not particularly limited and can be appropriately selected according to the purpose. Examples thereof include high molecular weight polyol and low molecular weight polyol.

Specific examples of the high molecular weight polyol include, but are not limited to, polyester polyol, i.e., a condensation of an alkylene glycol and an aliphatic dibasic acid such as polyester-based polyols such as polyester polyols of alkylene glycol and adipic acid such as ethlylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone based polyols such as polycaprolactone ester polyols obtained by ring-opening polymerization of caprolactone; and polyether-based polyols such as poly (oxytetramethylene) glycol, and poly (oxypropylene) glycol. Each of these materials can be used alone or in combination with others.

Specific examples of the polyol having a low molecular weight include, but are not limited to, diols such as 1,4-butanediol, ethylene glycol, neopentyl glycol, hydroxynone-bis(2-hydroxyethyl)ether, 3,3'-dichloro-4,4'-diamino diphenyl methane, 4,4'-diaminodiphenyl methane, and tri- or higher multivalent alcohols such as 1,1,1-trimethylol propane, glycerine, 1,2,6-hexane triol, 1,2,4-butanetriol, trimethylol ethane, 1,1,1-tris(hydroxyethyoxymethyl)propane, diglycerine, and pentaerythritol. Each of these materials can be used alone or in combination with others.

Specific examples of polyisocyanate compounds include, but are not limited to, diphenylmethane diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI), hydrogenated xylylene diisocyanate (H6XDI), dicyclohexyl methane diisocyanate (H12MDI), hexamethylene diisocyanate (HDI), dimer acid diisocyanate (DDI), Norbornene diisocyanate (NBDI), trimethylhexamethylene diisocyanate (TMDI), and the like. Each of these materials can be used alone or in combination with others.

The curing catalyst is not particularly limited and can be appropriately selected according to the purpose. As a curing catalyst, 2-methylimidazole and 1,2-dimethylimidazole can be used.

The content of the curing catalyst is not particularly limited and can be appropriately selected according to the purpose. The content of the curing catalyst preferably ranges from 0.01% to 0.5% by mass, and more preferably from 0.05% to 0.3% by mass.

The base 622 of the elastic member 624 is preferably 65° to 83° in Japanese Industrial Standards (JIS) A hardness.

In a case where the JIS-A hardness of the base 622 is less than 65°, it is difficult to obtain a line pressure of the cleaning blade 62, and the area of the contact portion with the image bearer as the cleaning target is likely to be enlarged, so that defective cleaning may occur. In a case where the JIS-A hardness of the base 622 is 83° or more, hardness becomes too hard and crack is likely to occur.

For example, it is preferable to use a laminate in which two or more types of rubber having different JIS-A hardnesses are molded in a single integrated unit as the base 622 to achieve both abrasion resistance and the ability to track.

The JIS-A hardness of the base 622 can be measured by a micro durometer MD-1 manufactured by Kobunshi Keiki Co., Ltd., for example.

The base 622 preferably has a rebound resilience, measured according to JIS-K 6255, of 36% to 73%, more preferably from 52% to 73%, at temperature of 23° C. In a case where the rebound resilience is lower than 36%, the elasticity of the entire elastic member 624 is lost, and it is difficult to follow the deflection and roughness of the image bearer, resulting in defective cleaning. In a case where the rebound resilience is more than 73%, repulsion becomes too strong and blade squeaking occurs.

The rebound resilience of the base 622 can be measured by a resilience measurement instrument No. 221 manufactured by Toyo Seiki Seisaku-sho, Ltd. according to JIS-K 6255 at temperature of 23° C.

The base 622 preferably has, but not limited, an average thickness of from 1.0 to 3.0 mm.

Surface Layer

The surface layer 623 is formed at the contact portion of the elastic member 624. The surface layer 623 is made of the cured product of the curable composition.

Examples of the curable composition include an ultraviolet curable compound (ultraviolet curable resin) and a thermosetting compound (thermosetting resin).

Ultraviolet Curable Compound

Examples of the ultraviolet curable compound include acrylate or methacrylate compounds having an alicyclic structure having 6 or more carbon atoms in a molecule having 2 functional groups.

In the acrylate or methacrylate compound having the alicyclic structure having 6 or more carbon atoms in the molecule having 2 functional groups, the number of carbon atoms in the alicyclic structure is preferably 6 to 12, more preferably 8 to 10. In a case where the number of carbon atoms is less than 6, the hardness of the contact portion may be lowered. In a case where the number of carbon atoms is more than 12, steric hindrance may occur.

The molecular weight of the acrylate or methacrylate compound having the alicyclic structure having 6 or more carbon atoms in the molecule having 2 functional groups is preferably 450 or less. On a case where the molecular weight is more than 500, the molecular size becomes so large that the elastic member becomes less likely to be impregnated with the compound and it may be more difficult to improve the hardness of the contact portion.

Specific preferred examples of the acrylate or methacrylate compound having 6 or more carbon atoms in a molecule having 2 functional groups include an acrylate or methacrylate compound having a tricyclodecane structure and an acrylate or methacrylate compound having an adamantane structure. These compounds have a special cyclic structure which can cover the shortage of cross-linking points although the number of functional groups is small.

Specific preferred examples of the acrylate or methacrylate compound having a tricyclodecane structure include, but are not limited to, tricyclodecane dimethanol diacrylate and tricyclodecane dimethanol dimethacrylate.

The acrylate or methacrylate compound having the tricyclodecane structure may be available either synthetically and commercially. Specific examples of commercially-available products of the acrylate or methacrylate compound having the tricyclodecane structure include, but are not limited to, A-DCP (available from Shin Nakamura Chemical Co., Ltd.).

Specific preferred examples of the acrylate or methacrylate compound having the adamantane structure include, but are not limited to, 1,3-adamantane dimethanol diacrylate, 1,3-adamantane dimethanol dimethacrylate.

In the case of curing by coating, for example, when spray coating is used to form the surface layer 623, the acrylate or methacrylate compound having a functional group equivalent weight of 350 or less and the number of functional groups of from 3 to 6, such as pentaerythritol triacrylate and dipentaerythritol hexaacrylate is preferred.

Further, the fluorine-based acrylic monomer can be preferably used because of effects thereof, such as lowering a friction coefficient of coating film surface and minimizing toner adhesion, and leveling function for improving the film-forming property.

Further, before the spray coating, the surface of the base 622 may be modified by impregnating the vicinity of the contact portion with the acrylic monomer. When impregnating the base 622, acrylate or methacrylate compounds having a tricyclodecane structure, such as tricyclodecane dimethanol diacrylate and tricyclodecane dimethanol dimethacrylate are preferable. Above-mentioned acrylates is known to be very effective for increasing the hardness and is preferably used.

Thermosetting Compound (Thermosetting Resin)

The thermosetting compound is preferably an isocyanate compound since polyurethane is used as the base 622. The isocyanate compound has 2 or more isocyanate groups in the molecule.

Examples of the isocyanate compound having two isocyanate groups include 2,4-tolylene diisocyanate, 2,6-tolylene diisocyanate, 4,4'-diphenylmethane diisocyanate (MDI), m-phenylene diisocyanate, tetramethylene diisocyanate, hexamethylene diisocyanate, 4,4',4"-triphenylmethane triisocyanate, 2,4',4"-biphenyl triisocyanate, 2,4,4"-diphenylmethane triisocyanate and the like.

It is also possible to use isocyanate compounds having 3 or more isocyanate groups or derivatives, modified products, and multimers of isocyanate compounds having 2 or more isocyanate groups.

Manufacturing Method of Elastic Member

As a manufacturing method of the elastic member 624 of the cleaning blade 62 according to the present embodiment, after the curable composition forming the surface layer 623 is applied to the base 622 and cured, the contact portion is cut to form a blade.

Figure 6A:
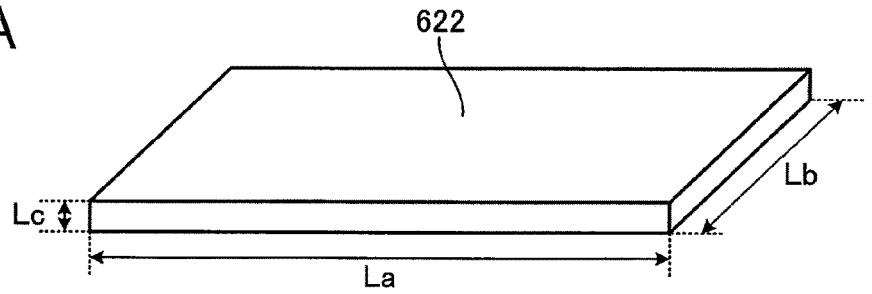
FIGS. 6A to 6C are schematic views illustrating manufacturing processes of the cleaning blade according to an embodiment of the present disclosure.
Figure 6B:
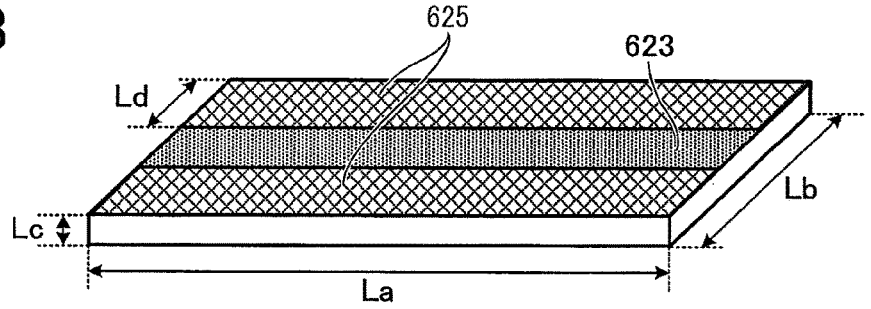
Figure 6C:
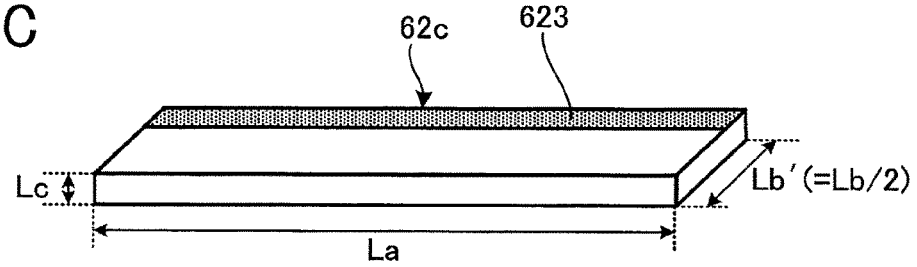

An example of the manufacturing process of the elastic member 624 is illustrated in FIGS. 6A to 6C.

FIG. 6A illustrates the base 622 before forming the surface layer 623. For example, a length La in the longitudinal direction is 326 mm, a width Lb is 23 mm, and a thickness Lc is 1.8 mm of the base 622, but not limited.

FIG. 6B illustrates a process of forming the surface layer 623. The curable composition is applied to a region not covered with a mask 625 and then cured to form the surface layer 623. The width Ld of the mask 625 can be appropriately selected according to the width of the surface layer 623 to be formed.

FIG. 6C illustrates a state in which the contact portion has been cut. The elastic member 624 in FIG. 6B is cut at a substantially central portion in the width direction. In this case, it is also possible to manufacture two elastic members 624 simultaneously.

Although a method of cutting can be appropriately selected, it is preferable to cut from the surface layer 623 side to the base 622 side, for example, using a vertical slicer or the like.

Image Forming Apparatus

Figure 4:
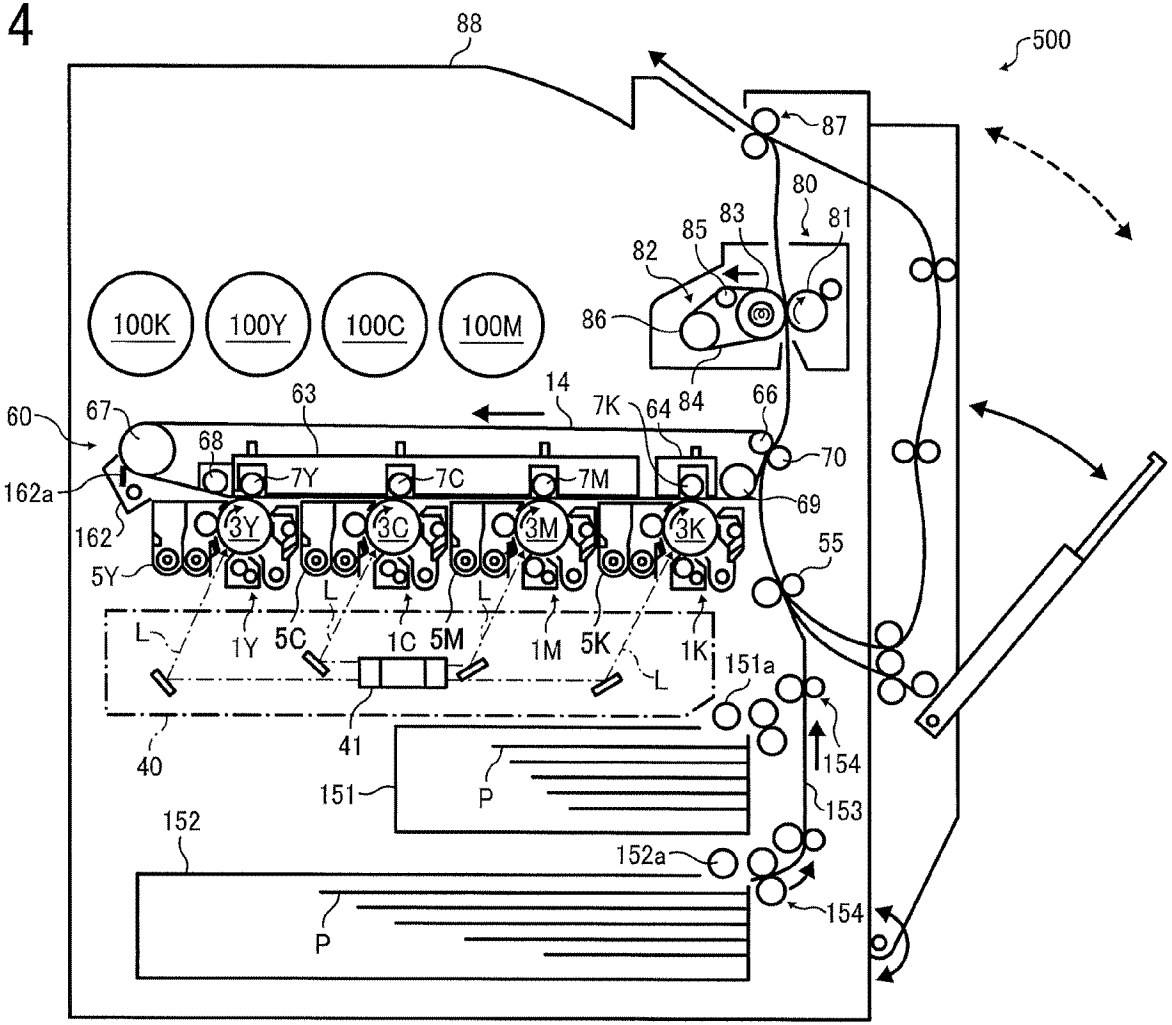
FIG. 4 is a schematic view illustrating an image forming apparatus according to an embodiment of the present disclosure.
Figure 5:
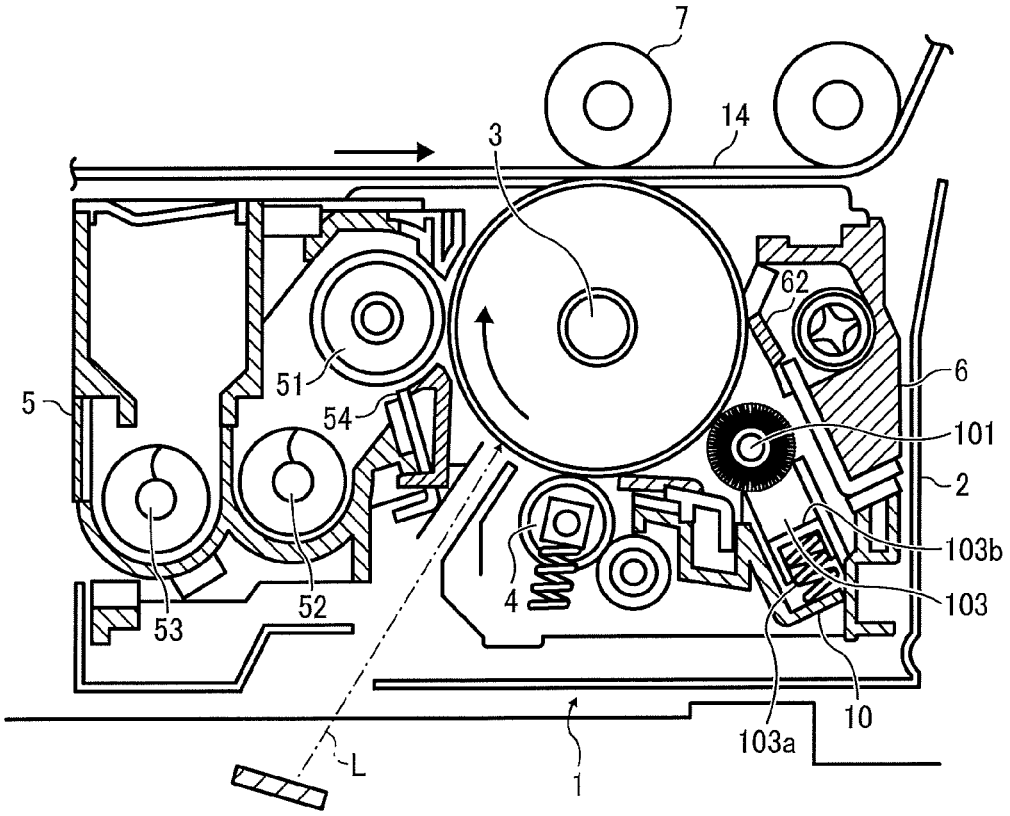
FIG. 5 is a schematic view illustrating an image forming unit employed in the image forming apparatus in FIG. 4.

FIG. 4 is schematic view illustrating the image forming apparatus 500 according to the present embodiment, and FIG. 5 is schematic view illustrating an image forming unit 1 mounted to the image forming apparatus 500.

The image forming apparatus 500 illustrated in FIG. 4 includes four image forming units 1Y, 1C, 1M, and 1K for forming yellow, cyan, magenta, and black images, respectively. The image forming units 1Y, 1C, 1M, and 1K have the same configuration except for storing different-color toners, i.e., yellow, cyan, magenta, and black toners, respectively.

Above the four image forming units 1Y, 1C, 1M, and 1K (hereinafter collectively "image forming units 1"), a transfer unit 60 is disposed. The transfer unit 60 includes an intermediate transfer belt 14 serving as an intermediate transferor. The image forming units 1Y, 1C, 1M, and 1K include respective photoconductors 3Y, 3C, 3M, and 3K on which toner images with respective color are to be formed. The toner images are superimposed one on another on a surface of the intermediate transfer belt 14.

Below the four image forming units 1, an optical writing unit 40 is disposed. The optical writing unit 40, serving as a latent image forming device (exposure device), irradiates the photoconductors 3Y, 3C, 3M, and 3K with laser light L based on image data in the respective image forming units 1Y, 1C, 1M, and 1K. Thus, electrostatic latent images for yellow, cyan, magenta, and black images are formed on the respective photoconductors 3Y, 3C, 3M, and 3K. Specifically, in the optical writing unit 40, the laser light L is emitted from a light source and directed toward the photoconductors 3Y, 3C, 3M, and 3K through multiple optical lenses and mirrors while being deflected by a polygon mirror 41 rotary-driven by a motor. Alternatively, the optical writing unit 40 can be replaced with another unit in which LED array performs optical scanning.

Below the optical writing unit 40, a first sheet tray 151 and a second sheet tray 152 are disposed overlapping with each other in the vertical direction. In each sheet tray, multiple sheets of recording medium P are stacked on top of another. The topmost recording media P are in contact with a first feeding roller 151*a* and a second feeding roller 152*a*, respectively. As the first feeding roller 151*a* is rotary-driven counterclockwise in FIG. 4 by a driver, the top most recording medium Pin the first sheet tray 151 is fed to a sheet feeding path 153 vertically extended on a right side of the first sheet tray 151 in FIG. 4. Alternatively, as the second feeding roller 152*a* is rotary-driven counterclockwise in FIG. 4 by a driver, the topmost recording medium P in the second sheet tray 152 is fed to the sheet feeding path 153.

On the sheet feeding path 153, multiple conveyance roller pairs 154 are disposed. The recording medium P is fed upward in FIG. 4 within the sheet feeding path 153 while being nipped by the conveyance roller pair 154.

A registration roller pair 55 is disposed on a downstream end of the sheet feeding path 153 in a direction of conveyance of the recording medium P. As soon as the registration roller pair 55 receives and sandwiches the recording medium P transported from the conveyance roller pair 154 therebetween, the registration roller pair 55 temporarily stops rotation thereof. The registration roller pair 55 then feed the recording medium P to a secondary transfer nip at a proper timing.

FIG. 5 is a schematic view of one of the four image forming units 1.

As illustrated in FIG. 5, the image forming unit 1 includes the photoconductor 3 (i.e., the photoconductor 3Y, 3C, 3M, or 3K) in a drum-like shape, serving as the image bearer. According to another embodiment, the photoconductor 3 may be in the form of a sheet or an endless belt.

Around the photoconductor 3, a charging roller 4, a developing device 5, a primary transfer roller 7, the cleaner 6, a lubricant applicator 10, and a neutralization lamp are disposed. The charging roller 4 serves as a charging member of a charger. The developing device 5 develops an electrostatic latent image formed on a surface of the photoconductor 3 into the toner image. The primary transfer roller 7 transfers the toner image from the surface of the photoconductor 3 onto the intermediate transfer belt 14. The cleaner 6 removes residual toner remaining on the photoconductor 3 after the toner image has been transferred therefrom onto the intermediate transfer belt 14. The lubricant applicator 10 applies lubricant to the surface of the photoconductor 3 cleaned with the cleaner 6. The neutralization lamp neutralizes a surface potential of the photoconductor 3 having been cleaned.

The charging roller 4 is disposed at a distance from the photoconductor 3 without contacting the photoconductor 3. The charging roller 4 charges the photoconductor 3 to a predetermined potential with a predetermined polarity. After the charging roller 4 has uniformly charged a surface of the photoconductor 3, the optical writing unit 40 irradiates the charged surface of the photoconductor 3 with the laser light L based on image data to form the electrostatic latent image.

The developing device 5 includes a developing roller 51 serving as a developer bearer. A developing bias is applied to the developing roller 51 from a power source. Inside a casing of the developing device 5, a supply screw 52 and a stirring screw 53 are disposed. The supply screw 52 and the stirring screw 53 convey developer stored in the casing in opposite direction each other to stir the developer. A doctor blade 54 is also disposed inside the casing to regulate the developer carried on the developing roller 51. As the developer is conveyed and stirred by the supply screw 52 and the stirring screw 53, toner in the developer are charged in a predetermined polarity. The developer is then drawn up on the surface of the developing roller 51 and regulated by the doctor blade 54. The toner in the developer adheres to the electrostatic latent image on the photoconductor 3 in a developing region where the developing roller 51 is facing the photoconductor 3.

The cleaner 6 includes a fur brush 101 and a cleaning blade 62. The cleaning blade 62 is in contact with the photoconductor 3 against the direction of surface movement of the photoconductor 3.

The lubricant applicator 10 includes a solid lubricant 103 and a lubricant pressing spring 103*a*. The solid lubricant 103 is applied to the photoconductor 3 by the fur brush 101 serving as an application brush. The solid lubricant 103 is held by a bracket 103*b* and is pressed toward the fur brush 101 side by the lubricant pressing spring 103*a*. The fur brush 101 rotates in the direction trailing rotation of the photoconductor 3, thereby scraping off the solid lubricant 103 and applying lubricant to the photoconductor 3. Owing to application of the lubricant to the photoconductor 3, the surface friction coefficient of the photoconductor 3 is maintained at 0.2 or less during non-image forming periods.

In the present embodiment, a non-contact closely-positioned charger, in which the charging roller 4 is disposed in proximity to the photoconductor 3 without contacting the photoconductor 3, is employed as the charger. Alternatively, any known charger such as a corotron, scorotron, or solid-state charger can also be used. In particular, contact chargers and non-contact closely-arranged chargers are preferred, since there are advantages of high charging efficiency, reduced ozone emissions, and compact size.

Light sources of laser light L emitted by the optical writing unit 40 and the neutralization lamp may be selected from among, for example, a fluorescent lamp, a tungsten lamp, a halogen lamp, a mercury lamp, a sodium-vapor lamp, a light-emitting diode (LED), a laser diode (LD), and an electroluminescence (EL).

For the purpose of emitting light having a desired wavelength only, any type of filter can be used such as a sharp cut filter, a band pass filter, a near infrared cut filter, a dichroic filter, an interference filter, and a color-temperature conversion filter.

Among the above-mentioned light sources, the light-emitting diode (LED) and laser diode (LD) are preferable because of high emission energy and long-wavelength light having a wavelength of from 600 to 800 nm.

As illustrated in FIG. 4, in addition to the intermediate transfer belt 14, the transfer unit 60 further includes a belt cleaner 162, a first bracket 63, and a second bracket 64. The transfer unit 60 further includes four primary transfer rollers 7Y, 7C, 7M, and 7K, a secondary-transfer backup roller 66, a driving roller 67, an auxiliary roller 68, and a tension roller 69. The intermediate transfer belt 14 is stretched taut with these eight rollers and is rotary-driven by the driving roller 67 to endlessly move counterclockwise in FIG. 4. The primary transfer rollers 7Y, 7C, 7M, and 7K and the respective photoconductors 3Y, 3C, 3M, and 3K are sandwiching the intermediate transfer belt 14 to form respective primary transfer nips therebetween. A transfer bias having the opposite polarity to the toner (e.g., positive polarity) is applied to the back surface (i.e., inner peripheral surface of the loop) of the intermediate transfer belt 14. As the intermediate transfer belt 14 endlessly moves while sequentially passing the primary transfer nips of yellow, cyan, magenta, and black, the toner images of yellow, cyan, magenta, and black formed on the respective photoconductors 3Y, 3C, 3M, and 3K are transferred and superimposed on one another onto the outer peripheral surface of the intermediate transfer belt 14. Thus, a superimposed multicolor (four colors in the present embodiment) toner image is formed on the intermediate transfer belt 14.

The secondary-transfer backup roller 66 and a secondary transfer roller 70, disposed outside the loop of the intermediate transfer belt 14, are sandwiching the intermediate transfer belt 14 to form the secondary transfer nip therebetween. The registration roller pair 55 forward the recording medium P clamped therebetween to the secondary transfer nip, timed to coincide with the four-color toner image on the intermediate transfer belt 14. In the secondary transfer nip, due to the effects of the secondary-transfer electric field generated between the secondary transfer roller 70, to which a secondary transfer bias is applied, and the secondary-transfer backup roller 66 and nip pressure, the four-color toner image is transferred secondarily from the intermediate transfer belt 14 onto the recording medium P all at once. The four-color toner image thus transferred forms a full-color toner image together with the white color of the recording medium P.

After the four-color toner image is transferred onto the recording medium P at the secondary transfer nip, residual toner that has failed to be transferred onto the recording medium P may remain on the intermediate transfer belt 14. Such residual toner is removed by the belt cleaner 162. The belt cleaner 162 includes a belt cleaning blade 162*a* in contact with the outer peripheral surface of the intermediate transfer belt 14. The belt cleaning blade 162*a* scrapes off the residual toner from the intermediate transfer belt 14.

It is to be noted that the first bracket 63 of the transfer unit 60 pivots a predetermined rotational angle around the axis of rotation of the auxiliary roller 68 in accordance with on-off driving of a solenoid. In a case where the image forming apparatus 500 is to form a monochrome image, the first bracket 63 is slightly rotated counterclockwise in FIG. 4 by driving the solenoid. This rotation of the first bracket 63 makes the primary transfer rollers 7Y, 7C, and 7M revolve counterclockwise in FIG. 4 about the rotation axis of the auxiliary roller 68 to separate the intermediate transfer belt 14 away from the photoconductors 3Y, 3C, and 3M. Thus, only the image forming unit 1K for black image is brought into operation to form a monochrome image. Since unnecessary driving of the image forming units 1Y, 1C, and 1M is minimized during formation of monochrome image, undesired deterioration of compositional members of the image forming units 1Y, 1C, and 1M can be prevented.

Above the secondary transfer nip, a fixing unit 80 is disposed as illustrated in FIG. 4. The fixing unit 80 includes a pressure heating roller 81 and a fixing belt unit 82. The pressure heating roller 81 contains a heat source, such as a halogen lamp, inside. The fixing belt unit 82 includes a fixing belt 84, serving as a fixing member, a heating roller 83, a tension roller 85, a driving roller 86, and a temperature sensor. The heating roller 83 contains a heat source, such as a halogen lamp, inside. The fixing belt 84, which is an endless belt, is stretched around the heating roller 83, the tension roller 85, and the driving roller 86 and rotated counterclockwise in FIG. 4. The fixing belt 84 is heated from a back surface side by the heating roller 83 while endlessly moving. At a position where the fixing belt 84 is wound around the heating roller 83, the pressure heating roller 81 is contacting the outer peripheral surface of the fixing belt 84. The pressure heating roller 81 is driven to rotate clockwise in FIG. 4. Thus, the pressure heating roller 81 and the fixing belt 84 form a fixing nip therebetween.

Outside the loop of the fixing belt 84, the temperature sensor is disposed facing the outer face of the fixing belt 84 across a predetermined gap to detect the surface temperature of the fixing belt 84 immediately before entering the fixing nip. The results of detection are transmitted to a fixing power supply circuit. The fixing power supply circuit on/off controls a power supply to the heat sources contained in the heating roller 83 and the pressure heating roller 81 based on the detection result.

After passing through the secondary-transfer nip, the recording medium P leaves the intermediate transfer belt 14 and enters the fixing unit 80. The recording medium P is fed upward in FIG. 4 while being sandwiched by the fixing nip of the fixing unit 80. During this process, the recording medium P is heated and pressurized by the fixing belt 84, and the full-color toner image is fixed on the recording medium P.

Then, the recording medium P is conveyed to an ejection roller pair 87 disposed downstream from the fixing unit 80 in the direction of conveyance of the recording medium P. The ejection roller pair 87 sandwiches the recording medium P therebetween and ejects the recording medium P onto a stack tray 88 on top of the image forming apparatus 500. Thus, the plurality of recording media P is stacked one atop another on the stack tray 88.

Above the transfer unit 60, four toner cartridges 100Y, 100C, 100M, and 100K, storing yellow toner, cyan toner, magenta toner, and black toner, respectively, are disposed. The respective color toners in the toner cartridges 100Y, 100C, 100M, and 100K are supplied to the developing devices 5Y, 5C, 5M, and 5K in the image forming units 1Y, 1C, 1M, and 1K as required. The toner cartridges 100Y, 100C, 100M, and 100K can be installed in and removed from an apparatus body separately from the image forming units 1Y, 1C, 1M, and 1K.

An image forming operation executed by the image forming apparatus 500 in the present embodiment is described below.

In response to receipt of a print execution signal from an operation device, the charging roller 4 and the developing roller 51 are each applied with a predetermined voltage or current at a predetermined timing. Similarly, a predetermined voltage or current is sequentially applied to each light source in the optical writing unit 40 and the neutralization lamp at a predetermined timing. In synchronization of the application of voltage or current, the photoconductor 3 is driven to rotate in a direction indicated by arrow in FIG. 4 by a photoconductor driving motor.

As the photoconductor 3 rotates clockwise in FIG. 4, the surface of the photoconductor 3 is uniformly charged to a predetermined potential by the charging roller 4. The optical writing unit 40 irradiates the charged surface of the photoconductor 3 with the laser light L based on image data. That part of the photoconductor 3 onto which the laser light L is directed is neutralized, thereby forming the electrostatic latent image.

The surface of the photoconductor 3 having the electrostatic latent image thereon is rubbed by a magnetic brush formed of the developer on the developing roller 51 at a position where the photoconductor 3 is facing the developing device 5. As a developing bias is applied to the developing roller 51, negatively-charged toner on the developing roller 51 is transferred onto the electrostatic latent image, thus forming the toner image. Such image forming process is performed in each of the image forming units 1Y, 1C, 1M, and 1K to form yellow, cyan, magenta, and black toner images on the photoconductors 3Y, 3C, 3M, and 3K, respectively.

Thus, in the image forming apparatus 500, the developing device 5 develops the electrostatic latent image formed on the photoconductor 3 with toner charged in negative polarity by reversal development. In the present embodiment, a negative-positive (N/P) development (in which toner adheres to low-potential regions) and a non-contact charging roller 4 are employed, but the development and charging types are not limited thereto.

The toner images of yellow, cyan, magenta, and black formed on the respective photoconductors 3Y, 3C, 3M, and 3K are primarily transferred and superimposed one on another onto the surface of the intermediate transfer belt 14. Thus, the four-color toner image is formed on the intermediate transfer belt 14.

The four-color toner image (hereinafter "toner image" for simplicity) formed on the intermediate transfer belt 14 is transferred onto the recording medium P which has been fed from the first sheet tray 151 or second sheet tray 152, passed through the registration roller pair 55, and fed to the secondary transfer nip. The recording medium P is once stopped by being sandwiched by the registration roller pair 55, and then fed to the secondary transfer nip in synchronization with an entry of the leading edge of the toner image on the intermediate transfer belt 14. The recording medium P having the transferred toner image thereon is then separated from the intermediate transfer belt 14 and fed to the fixing unit 80. As the recording medium P having the transferred toner image thereon is passed through the fixing unit 80, the toner image is fixed on the recording medium P by heat and pressure. The recording medium P having the fixed toner image thereon is ejected outside the image forming apparatus 500 and stacked on the stack tray 88.

On the other hand, after the toner image has been transferred from the surface of the intermediate transfer belt 14 onto the recording medium P in the secondary transfer nip, the belt cleaner 162 removes residual toner remaining on the surface of the intermediate transfer belt 14.

Similarly, after the toner image has been transferred from the surface of the photoconductor 3 onto the intermediate transfer belt 14 in the primary transfer nip, the cleaner 6 removes residual toner remaining on the surface of the photoconductor 3. The lubricant applicator 10 then applies lubricant to the cleaned surface and the neutralization lamp further neutralizes the surface.

As illustrated in FIG. 5, the image forming unit 1 of the image forming apparatus 500 has a frame 2 storing the photoconductor 3 and processing devices including the charging roller 4, the developing device 5, the cleaner 6, and the lubricant applicator 10. The image forming unit 1 is temporarily detachable from the apparatus body of the image forming apparatus 500 as the process cartridge. The photoconductor 3 and the processing devices are replaceable as the process cartridge in the present embodiment, but each unit of the photoconductor 3, the charging roller 4, the developing device 5, the cleaner 6, and the lubricant applicator 10 can be separately replaceable with a new device. The lubricant applicator 10 may not be used.

The toner for use in the image forming apparatus 500 is preferably a polymerization toner manufactured by a suspension polymerization method, an emulsion polymerization method, or a dispersion polymerization method by which toner having a small particle diameter and a form closer to a true sphere is easily granulated to improve the image quality. From the viewpoint of forming a high-resolution image, it is more preferable to use a polymerization toner having a volume average particle diameter of 5.5 μm or less.

Process Cartridge

The process cartridge according to the present embodiment includes the image bearer and the cleaner 6 to remove toner remaining on the image bearer. The process cartridge may optionally include other devices, if necessary.

The cleaner 6 includes above-described cleaning blade 62 according to the present embodiment.

The process cartridge includes the image bearer and the cleaning blade 62 of the present embodiment, and at least one of the charger, an exposure device, the developing device 5, a transfer device, and a charge eliminating device. The process cartridge is detachably attached to the apparatus body of the image forming apparatus 500.

Image Forming Method

The image forming method according to the present embodiment includes a charging process, an exposure process, a developing process, a transfer process, a fixing process, and a cleaning process, and further includes optional processes, if necessary. The charging and exposure processes may be hereinafter collectively referred to as an electrostatic latent image forming process.

The image forming method of the present disclosure is suitably performed by the image forming apparatus 500 of the present disclosure. The charging process is performed by the charger. The exposure process is performed by the exposure device. The development process is performed by the developing device 5. The transfer process is performed by the transfer device. The cleaning process is performed by the cleaner. The other optional processes are performed by the corresponding optional devices.

The image bearer (hereinafter may be referred to as "electrophotographic photoconductor" or simply "photoconductor") is not limited in material, shape, structure, and size. The shape of the image bearer may be a drum shape, a belt shape, and the like. Specific examples of the materials for image bearer include, but are not limited to, inorganic compounds such as amorphous silicon, selenium; and organic compounds such as polysilane and phthalopolymethine.

Charging Process and Charging Device

The charging process is conducted by the charger to charge the surface of the image bearer.

In the charging process, the charger applies a voltage to the surface of the image bearer to charge the surface.

Specific examples of the charger include, but are not limited and can be appropriately selected according to the purpose, a contact charger equipped with a conductive or semi-conductive roller, brush, film, or rubber blade, and a non-contact charger such as corotron and scorotron that use corona discharge.

The charger may employ any form, such as a roller, a magnetic brush, and a fur brush and can be selected according to the specification or form of an image forming apparatus. In a case where the charger employs the magnetic brush, the magnetic brush includes ferrite particles, such as Zn—Cu ferrite, serving as charging members; a non-magnetic conductive sleeve for supporting the ferrite particles; and a magnet roll contained in the sleeve. In a case where the fur brush is used, fur treated to have electroconductivity with carbon, copper sulfide, metal, or metal oxide is used as the fur brush material and rolled on or attached to metal core or core treated to have electroconductivity to make the charger.

The charger is not limited to the contact type charger described above, but using such a contact type charger is advantageous because an image forming apparatus using the contact type charger produces a less amount of ozone.

It is preferable to apply a direct current and an alternating current voltage in superimposition to the surface of the image bearer by the charger disposed in contact with or in the vicinity of the image bearer.

It is also preferable that the charger disposed in the vicinity of the image bearer via a gap tape to avoid contact with the image bearer applies a direct current and an alternating current voltage in superimposition to the surface of the image bearer.

Exposure Process and Exposure Device

The exposure process is conducted by the exposure device to irradiate the surface of the charged image bearer.

The exposure device irradiates the surface of image bearer with light containing image data.

The optical system in the exposure is classified into an analog optical system and a digital optical system. The analog optical system projects an original document directly on the image bearer, and the digital optical system receives image data as electric signals, converts the electric signals into optical signals, and irradiates the image bearer to form images.

The exposure device is not limited and can be appropriately selected according to the purpose as long as the exposure device can irradiate the surface of image bearer with light containing image data. Specific examples of such exposure device includes a photocopying optical system, a rod lens array system, a laser optical system, a liquid crystal shutter optical system, and an LED optical system.

Embodiments of the present disclosure can employ a dorsal exposing system in which the image bearer is irradiated according to image data from the rear side thereof.

Developing Process and Developing Device

The developing process is a process of developing the electrostatic latent image with the toner to form a visible image (toner image).

The visible image is formed by, for example, developing the electrostatic latent image with toner by the developing device 5.

There is no specific limit to the developing device 5 as long as the developing device 5 can develop the electrostatic latent image with the toner, and any known developing device can be used. For example, the developing device 5 which accommodates and applies the toner to the electrostatic latent image in a contact or non-contact manner is suitably used.

The developing device 5 may employ either dry developing method or wet developing method. The developing device 5 may be for either monochrome development or multicolor development. For example, the developing device 5 including an agitator to frictionally agitate the toner for charging and a rotatable magnet roller is preferable.

In the developing device 5, toner and carrier are mixed and stirred, and the toner is charged by friction. The charged toner and carrier are formed into chain-like cluster and retained on the surface of the magnet roller that is rotating, thus forming a magnetic brush. The magnet roller is disposed adjacent to the image bearer. Therefore, a part of the toner composing the magnetic brush formed on the surface of the magnet roller is moved to the surface of the image bearer by an electric attractive force. As a result, the electrostatic latent image is developed with the toner to form the visible image (toner image) on the surface of the image bearer.

The developing device 5 may accommodate a developer including the toner, and the developer can be a monocomponent developer or a two-component developer.

Transfer Process and Transfer Device

The transfer process is a process in which the visible image is transferred to the recording medium. It is preferable that the visible image be primarily transferred to an intermediate transferor and thereafter secondarily transferred to the recording medium P. Further, it is more preferable that two or more colors of toner, preferably full colors of toner, be used, the visible image for each color toner be primarily transferred to the intermediate transferor to form a composite toner image, and the composite toner image be thereafter secondarily transferred to the recording medium P.

For example, the visible image is transferred as the transfer device charges the image bearer. The transfer device preferably includes a primary transfer device to transfer the visible images onto the intermediate transferor to form the composite toner image and a secondary transfer device to transfer the composite toner image onto the recording medium P.

There is no specific limitation to the intermediate transferor, and any known transferor can be suitably selected. For example, a transfer belt is preferably used.

The transfer device (primary transfer device and secondary transfer device) preferably includes a transferor to separate the visible image formed on the image bearer to the recording medium side by charging. The transfer device may include multiple transfer devices. Specific examples of the transfer device include, but are not limited to, a corona transferor using corona discharge, a transfer belt, a transfer roller, a pressure transfer roller, and an adhesive transferor.

The recording medium P is not limited in material as long as the toner image can be transferred and may be plain paper, polyethylene terephthalate (PET) films for use in overhead projector (OHP), etc.

Fixing Process and Fixing Unit

The fixing process is a process of fixing the transferred toner image on the recording medium P. The fixing process can be performed by the fixing unit 80. In a case where two or more colors of toner are used, the toner image may be fixed each time the toner image of each color is transferred to the recording medium P, or alternatively, the toner images of all the colors may be transferred onto the recording medium P and fixed in a superimposed state. The fixing unit 80 is not limited and can be any known thermal fixing method employing heat-pressure member. Specific examples of the heat-pressure member include, but are not limited to, a combination of a heat roller and a pressure roller; and a combination of a heat roller, a pressure roller, and an endless belt. In this case, preferably, the heating temperature is in a range of from 80° C. to 200° C. The fixing unit 80 may be used together with or replaced with an optical fixing unit, in accordance with intended use.

Cleaning Process and Cleaning Device

The cleaning process is a process in which residual toner remaining on the image bearer is removed, which is preferably performed by the cleaner 6.

The cleaner 6 includes above-described cleaning blade 62 according to the present embodiment.

It is preferable that the elastic member 624 of the cleaning blade 62 be in contact with the surface of the image bearer as the cleaning target with a pressing force of 10 N/m to 100 N/m. In a case where the pressing force is less than 10 N/m, defective cleaning is likely to occur due to toner passing through the contact portion where the elastic member 624 of the cleaning blade 62 abuts against the surface of the image bearer. In a case where the pressing force is more than 100 N/m, the cleaning blade 62 may turn up due to an increase in the frictional force at the contact portion. The pressing force is preferably 10 N/m to 50 N/m.

For example, the pressing force can be measured with a measuring instrument incorporating a small-sized compression load cell manufactured by Kyowa Electronic Instruments Co., Ltd.

An angle formed by a tangent at the contact portion where the elastic member 624 of the cleaning blade 62 abuts against the surface of the image bearer and the end face 62*a* of the cleaning blade is preferably 65° or more and 85° or less, but not particularly limited and may be appropriately selected according to the purpose.

In a case where the angle is less than 65°, the cleaning blade may turn up. In a case where the angle exceeds 85°, defective cleaning may occur.

Other Processes and Other Devices

The other devices may include, for example, a neutralizer, a recycler, and a controller.

The other processes may include, for example, a neutralization process, a recycle process, and a control process.

Neutralization Process and Neutralizer

The neutralization process is a process in which the image bearer is neutralized by application of a neutralization bias, which is preferably performed by the neutralizer.

The neutralizer is not limited in configuration and can be selected from any known neutralizer so long as a neutralization bias can be applied to the image bearer. Specific examples of the neutralizer include, but are not limited to, a neutralization lamp.

Recycle Process and Recycler

The recycle process is a process in which the toner removed in the cleaning process is recycled to be used by the developing device 5 and is preferably performed by a recycler.

The recycler is not limited in configuration. Specific examples of the recycler include, but are not limited to, any known conveyor.

Control Process and Controller

The control process is a process in which the above-descried processes are controlled, which is preferably performed by the controller.

The controller is not limited in configuration so long as the above-described processes can be controlled. Specific examples of the controller include, but are not limited to, sequencer and computer.

EXAMPLES

Further understanding can be obtained by reference to certain specific examples which are provided herein for the purpose of illustration only and are not intended to be limiting.

Manufacture of Base

As a base material of the elastic member, a polyurethane rubber (manufactured by Nitta Chemical Industrial Products Co., Ltd.) having physical properties: hardness of 76 and rebound resilience of 36% at 23° C. was used. The flat-shaped base 622 having the average thickness of 1.8 mm, the width of 23 mm, and the length of 326 mm in the longitudinal direction was manufactured.

Preparation of Curable Composition

Four kinds of curable compositions (hereinafter referred to as "coating liquids") for forming the surface layer 623 were prepared with the following composition.

Coating Liquid 1

Tricyclodecane dimethanol diacrylate (A-DCP manufactured by Shin Nakamura Chemical Co., Ltd.): 100 parts by weight Fluorine-based acrylic monomer (OPTOOL™ DAC-HP manufactured by Daikin Industries, Ltd.): 2.5 parts by weight Polymerization initiator (Omnirad™ 184, former Irgacure™ 184, manufactured by IGM Resins B.V.): 5 parts by weight Solvent: Cyclohexanone: 400 parts by weight Coating Liquid 2

Dipentaerythritol hexaacrylate (DPHA manufactured by DAICEL-ALLNEX LTD.): 100 parts by weight Fluorine-based acrylic monomer (OPTOOL™ DAC-HP manufactured by Daikin Industries, Ltd.): 2.5 parts by weight Polymerization initiator (Omnirad™ 184, former Irgacure™ 184, manufactured by IGM Resins B.V.): 1.5 parts by weight Solvent: Cyclohexanone: 900 parts by weight Coating Liquid 3

Isocyanurate form of hexamethylene diisocyanate (Takenate™ D170N manufactured by Mitsui Chemicals, Inc.): 100 parts by weight Bismuth catalyst (Neostan U-600, manufactured by Nitto Kasei Co., Ltd.): 500 ppm Solvent: butyl acetate: 400 parts by weight Coating Liquid 4

Isocyanurate form of hexamethylene diisocyanate (Takenate™ D170N manufactured by Mitsui Chemicals, Inc.): 100 parts by weight Fluoroethylene/vinyl ether alternating copolymer (Lumiflon™ LF 200MEK, manufactured by Asahi Glass Co., Ltd.): 50 parts by weight Bismuth catalyst (Neostan U-600, manufactured by Nitto Kasei Co., Ltd.): 500 ppm Solvent: butyl acetate: 400 parts by weight Formation of Surface Layer One surface of the base 622 was covered with the mask 625 leaving a region for forming the surface layer 623, and the above-mentioned coating liquid was applied. The mask was removed and curing treatment was performed to form the surface layer 623.

Manufacture of Cleaning Blade

The base 622 on which the surface layer 623 was formed was cut at the center in the width direction to obtain the strip-shaped elastic member 624.

One end of the elastic member 624 on the side where the surface layer was not formed was secured to the support 621 (plate holder) with an adhesive so that the elastic member 624 can be mounted in the image forming apparatus 500.

Assembling of Image Forming Apparatus

The prepared cleaning blade 62 was attached to the image forming apparatus 500 (color multifunction peripheral: imagio MP C4500, manufactured by Ricoh Company, Ltd.) so that the line pressure was 20 g/cm and the cleaning angle was 79°.

Measurement of Shape of Surface Layer

As illustrated in FIG. 3, the elastic member 624 was cut along a plane perpendicular to the longitudinal direction and observed with a digital microscope (VHX-2000, manufactured by Keyence Corporation) with the cut face facing upward. Observation was performed on the region where the surface layer 623 was formed, and the thickness at the ridgeline, the inclination angle, and the width of the surface layer 623 were measured. The obtained values are illustrated in Tables 1A and 1B.

Measurement of Martens (HM) Hardness of Surface Layer

Indentation measurement was performed on the central portion (corresponding to the ridgeline portion) of the surface layer 623 formed on the elastic member 624 by using a micro-hardness measurement instrument to obtain Martens (HM) hardness.

Using a HM-2000 micro-hardness measurement instrument manufactured by Fischer Instruments K.K., a Vickers indenter was pushed for 10 seconds with a force of 1.0 mN, held for 5 seconds, and unloaded with a force of 1.0 mN for 10 seconds. The obtained values are illustrated in Tables 1A and 1B.

Example 1

The Coating liquid 1 was spray-coated on the surface of the base 622 made of polyurethane rubber with a mask width of 5 mm.

The spray gun was SV-91 manufactured by SAN-EI TECH LTD. The gun tip faced the center part of the coating part and the distance from the gun tip to the surface of the base 622 was 60 mm. In the spray gun, the coating liquid discharge rate was 0.04 cc/min, the atomization pressure was 0.05 MPa, and the surface of the base 622 was reciprocated repeatedly in the longitudinal direction at 5 mm/s.

Next, the mask was removed and ultraviolet irradiation (conveyor speed 54 mm/min, integrated illuminance 4000 mJ/cm$^2$) was performed twice using an ultraviolet irradiation device (ECS-1511 U manufactured by EYE GRAPHICS CO., LTD.). Drying was carried out at an internal temperature of 100° C. for 15 minutes by a thermal dryer to form the surface layer 623.

The central portion of the elastic member 624 where the surface layer was formed was cut, and one end of the elastic member 624 without the surface layer was fixed to the plate holder as the support 621 with the adhesive to manufacture the cleaning blade 62 of type 1.

The prepared type 1 cleaning blade 62 was attached to the image forming apparatus 500 and an operation test was conducted to evaluate the ability to track and cracks based on the following criteria. The results are presented in Table 1A.

Tracking Ability Evaluation

The ability to track of the cleaning blade 62 was evaluated based on the presence or absence and extent of abnormal noise (blade squeaking), chattering and turning of the cleaning blade during the operation test. Operation tests were conducted under the following condition: Laboratory environment: temperature of 27° C., humidity of 80% RH Paper passing condition: Chart having an image area rate of 5%, 3 prints per job until 10,000 sheets of A4 landscape The abnormal noise was confirmed by the ear of the observer, and it was judged as an abnormal sound without distinction if the noise was coming out from the cleaning blade 62. In a case where the abnormal noise (blade squeaking) does not occur, the magnitude of the rotational torque of the photoconductor is estimated based on a current value of a drive motor for rotating the photoconductor 3. The results of these observations were evaluated based on the following criteria.

Evaluation Criteria

Very Good: There is no abnormal noise, chattering and turning of the cleaning blade, and the torque of the driving motor of the photoconductor is extremely low.

Good: There is no abnormal noise, chattering, and turning up of the cleaning blade.

Bad: Noise is generated at the time of stoppage and at the start of driving, or an abnormal noise occurs during driving.

Very Bad: An abnormal noise is generated during driving, stoppage, and start of driving. Alternatively, turning up of the cleaning blade 62 occurs.

Crack Evaluation (Cleaning Capability Evaluation)

The cracks of the cleaning blade were evaluated based on the presence or absence of toner slipping through and the extent thereof. Operation tests were conducted under the following condition:

Laboratory environment: temperature of 10° C., humidity of 15% RH

Paper passing condition: Chart having an image area rate of 5%, 3 prints per job until 10,000 sheets of A4 landscape After prints of 10,000 sheets, a halftone image was output, the image and the photoconductor 3 were visually observed and evaluated based on the following criteria.

Evaluation Criteria:

Very Good: There is no trace of toner slipping through on the photoconductor 3, and no abnormality is observed on the image.

Good: There is trace that the toner slips through on a part of the photoconductor, but noticeable marks are not observed on the image.

Bad: Some of the toner on the photoconductor has passed through toner that can be visually distinguished, and abnormality is also observed on the image.

Very Bad: A large amount of toner slipped through the entire photoconductor to such an extent that it can be visually distinguished, and abnormality is also observed on the image.

Note that, "Very Good" and "Good" as image quality are levels with no problem, and "Bad" and "Very Bad" are problematic levels.

Examples 2 to 3

Cleaning blades 62 of type 2 and 3 were prepared in the same manner as in Example 1, except that the mask layer was changed to form the surface layer as illustrated in Table 1A, and the cleaning blades 62 of type 2 and 3 were attached to the image forming apparatus 500 in the same manner as in Example 1. The operation test was conducted to evaluate the crack.

Table 1A illustrates the shape and hardness values of the surface layer 623 and evaluation results.

Examples 4 to 5

Cleaning blades 62 of type 4 and 5 were prepared in the same manner as in Example 1 except that the mask width was changed as illustrated in Table 1A and the surface layer was formed using the coating liquid 2, The cleaning blades 62 of type 4 and 5 paper were attached to the image forming apparatus 500, and the operation test was conducted to evaluate the crack.

Table 1A illustrates the shape and hardness values of the surface layer 623 and evaluation results.

Example 6

The Coating liquid 3 was spray-coated on the surface of the base 622 made of polyurethane rubber with a mask width of 5 mm.

The spray gun was SV-91 manufactured by SAN-EI TECH LTD. The gun tip faced the center part of the coating part and the distance from the gun tip to the surface of the base 622 was 60 mm. In the spray gun, the coating liquid discharge rate was 0.06 cc/min, the atomization pressure was 0.08 MPa, and the surface of the base 622 was reciprocated repeatedly in the longitudinal direction at 5 mm/s.

Next, the mask 625 was removed and dried for 60 minutes at an internal temperature of 130° C. using the thermal dryer to form the surface layer 623.

The central portion of the elastic member 624 where the surface layer 623 was formed was cut, and on end of the elastic member 624 without the surface layer 623 was fixed to the plate holder as the support 621 with the adhesive to manufacture the cleaning blade 62 of type 6.

The prepared cleaning blade 62 of type 6 was attached to the image forming apparatus 500 in the same manner as in Example 1, and the operation test was conducted to evaluate the crack.

Table 1A illustrates the shape and hardness values of the surface layer 623 and evaluation results.

Example 7

Cleaning blades 62 of type 7 was prepared in the same manner as in Example 6 except that the mask width was changed as illustrated in Table 1A and attached to the image forming apparatus 500, and the operation test was conducted to evaluate in the same manner as in Example 1.

Table 1A illustrates the shape and hardness values of the surface layer 623 and evaluation results.

Example 8

A cleaning blade 62 of type 8 was prepared in the same manner as in Example 6 except that the mask width was changed and the coating liquid 4 was used to form the surface layer 623 as illustrated in Table 1A. The cleaning blade 62 of type 8 was attached to the image forming apparatus 500, and the operation test was conducted to evaluate in the same manner as in Example 1.

Table 1A illustrates the shape and hardness values of the surface layer 623 and evaluation results.

Comparative Example 1

A cleaning blade 62 of type 9 was prepared in the same manner as in Example 1 except that a polyurethane rubber having an average thickness of 1.8 mm, width of 11.5 mm, and length of 326 mm was used as the elastic member without forming a surface layer 623 on the base 622. The cleaning blade 62 of type 9 was attached to the image forming apparatus 500, and the operation test was conducted to evaluate in the same manner as in Example 1. The evaluation results are described in Table 1B. The value of the surface hardness in Table 1B is the value of the base 622.

Comparative Example 2

A cleaning blade 62 of type 10 was prepared in the same manner as in Example 1 except that the mask width was changed and the coating liquid 2 was used to form the surface layer 623 as illustrated in Table 1B. The cleaning blade 62 of type 10 was attached to the image forming apparatus 500, and the operation test was conducted to evaluate in the same manner as in Example 1.

Table 1B illustrates the shape and hardness values of the surface layer 623 and evaluation results.

Comparative Example 3

As illustrated in Table 1B, the mask width was changed, and the coating liquid 3 was applied by a slit die coating method (the slit width of the die was larger than the coating width) to form the surface layer 623 having a uniform thickness. Cleaning blades 62 of type 11 was prepared in the same manner as in Example 1 except the above described coating condition and attached to the image forming apparatus 500, and the operation test was conducted to evaluate in the same manner as in Example 1.

Table 1B illustrates the shape and hardness values of the surface layer 623 and evaluation results.

Comparative Example 4

A cleaning blade 62 of type 12 was prepared in the same manner as in Example 6 except that the mask width was changed and the coating liquid 4 was used to form the surface layer 623 as illustrated in Table 1B. The cleaning blade 62 of type 12 was attached to the image forming apparatus 500, and the operation test was conducted to evaluate in the same manner as in Example 1.

Table 1B illustrates the shape and hardness values of the surface layer 623 and evaluation results.

TABLE 1A

| | Example | | | | | | | |
|---|---|---|---|---|---|---|---|---|
| | 1 | 2 | 3 | 4 | 5 | 6 | 7 | 8 |
| Cleaning blade No. | 1 | 2 | 3 | 4 | 5 | 6 | 7 | 8 |
| Coating liquid | 1 | 1 | 1 | 2 | 2 | 3 | 3 | 4 |
| Mask width (mm) | 5 | 9 | 3.5 | 3 | 9.5 | 8 | 10 | 10.5 |
| Film thickness (μm) | 80 | 50 | 10 | 30 | 150 | 120 | 180 | 200 |
| Inclination angle θ (°) | 0.7 | 1.1 | 0.1 | 0.2 | 4.3 | 2.0 | 6.8 | 11.3 |
| Width (mm) | 6.5 | 2.5 | 8 | 8.5 | 2 | 3.5 | 1.5 | 1 |
| Martens hardness (N/mm$^2$) | 7.0 | 6.0 | 3.0 | 4.5 | 12.0 | 5.0 | 8.5 | 10.0 |
| Ability to track evaluation | Very Good | Very Good | Good | Good | Good | Very Good | Good | Good |
| Crack evaluation | Good | Very Good | Very Good | Very Good | Good | Good | Good | Good |

TABLE 1B

| | Comparative Example | | | |
|---|---|---|---|---|
| | 1 | 2 | 3 | 4 |
| Cleaning blade No. | 9 | 10 | 11 | 12 |
| Coating liquid | — | 2 | 3 | 4 |
| Mask width (mm) | — | 10.5 | 9 | 3 |
| Film thickness (μm) | — | 210 | 130 | 9 |
| Inclination angle θ (°) | 0 | 11.9 | — | 0.06 |
| Width (mm) | — | 1 | 2.5 | 8.5 |
| Martens hardness (N/mm$^2$) | 1.0 | 13.0 | 4.0 | 2.0 |
| Ability to track evaluation | Very Bad | Good | Very Bad | Bad |
| Crack evaluation | Bad | Very Bad | Very Bad | Bad |

As illustrated in Table 1A, the cleaning blades 62 of Examples 1 to 8 satisfy the condition that the surface layer 623 includes an inclined face inclined on the cross section perpendicular to the longitudinal direction so that the thickness of the surface layer 623 progressively decreases toward the secured end side, the thickness at the ridgeline of the surface layer 623 is 10 to 200 μm, and the angle θ between the inclined face and the lower surface of the base 622 is 0.1° to 11.3°. Therefore, even in long-term use, the ability to track did not decrease and occurrence of blade crack was minimized.

On the other hand, as illustrated in Table 1B, in Comparative Example 1 in which the surface layer was not provided, Comparative Examples 2 and 4 in which the thickness and inclined angles were out of the predetermined ranges, and Comparative Example 3 without inclined surfaces decrease of the ability to track and blade crack occurred, and the sufficient cleaning capability was not obtained.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A cleaning blade comprising:

a support; and an elastic member with a flat shape including a secured end secured to the support and a free end having a ridgeline to contact a cleaning target to remove substance adhering to a surface of the cleaning target, the elastic member including:

a base having an opposite face disposed to oppose a downstream side of the cleaning target downstream from a contact portion of the elastic member with the cleaning target in a direction of movement of the cleaning target; and a surface layer made of a cured product of a curable composition, the surface layer disposed on at least a part of the opposite face of the base, the surface layer including an inclined face inclined such that a thickness of the surface layer progressively decreases toward the secured end along a cross section perpendicular to a longitudinal direction of the surface layer.

2. The cleaning blade according to claim 1, wherein the thickness of the surface layer is 10 to 200 μm at the ridgeline, and wherein an angle between the inclined face of the surface layer and the opposite face of the base is 0.1° to 11.3°.

3. The cleaning blade according to claim 1, wherein the surface layer extends for 1 to 8 mm from the contact portion.

4. The cleaning blade according to claim 1, wherein a Martens hardness of the surface layer measured by a micro-hardness measurement instrument is 3.0 to 12 $N/mm^2$ at the ridgeline of the surface layer.

5. The cleaning blade according to claim 1, wherein the curable composition is one of thermosetting resin and ultraviolet curable resin.

6. A process cartridge comprising:

an image bearer to bear a toner image; and a cleaner including the cleaning blade according to claim 1 to remove the substance adhering to a surface of the image bearer as the cleaning target.

7. An image forming apparatus comprising:

an image bearer to bear a toner image;

a charger to charge a surface of the image bearer;

an exposure device to expose the surface of the image bearer charged with the charger to form an electrostatic latent image;

a developing device to develop the electrostatic latent image into the toner image;

a transfer device to transfer the toner image from the image bearer onto a recording medium;

a fixing device to fix the toner image on the recording medium; and a cleaner including the cleaning blade according to claim 1 to remove the substance adhering to the surface of the image bearer as the cleaning target.

* * * * *